United States Patent [19]

Hsu

[11] 4,332,112

[45] Jun. 1, 1982

[54] MULTIPURPOSE AIR FILLING TENT

[76] Inventor: Yun T. Hsu, 3rd Fl., No. 4, Nong 6, La. 906, Min Sheng E. Rd., Taipei, Taiwan

[21] Appl. No.: 130,339

[22] Filed: Mar. 14, 1980

[51] Int. Cl.[3] ..... E04B 1/34

[52] U.S. Cl. ..... 52/2

[58] Field of Search ..... 52/2; 206/287

[56] References Cited

U.S. PATENT DOCUMENTS

| | | | |
|---|---|---|---|
| 2,875,771 | 3/1959 | Brewin | 52/2 |
| 3,097,854 | 6/1963 | Manhart | 52/2 |
| 3,877,084 | 4/1975 | Johnson | 52/2 |
| 4,000,749 | 1/1977 | Basco | 52/2 |
| 4,128,204 | 12/1978 | Wade | 52/2 |
| 4,171,595 | 10/1979 | Tucker | 52/2 |

*Primary Examiner*—Price C. Faw, Jr.
*Assistant Examiner*—Henry E. Raduazo
*Attorney, Agent, or Firm*—Cushman, Darby & Cushman

[57] ABSTRACT

A multipurpose air-filled tent. The tent interior includes various equipment for household use, such as a mattress, a clothes closet, garmet hangers, a storage rack, storage bags. Three different models are designed for sleeping, bathing and dressing, respectively.

3 Claims, 5 Drawing Figures

MULTIPURPOSE AIR FILLING TENT

BACKGROUND OF THE INVENTION

Camping is becoming increasingly popular, particularly because industries and commercial businesses are greatly developing, people usually live together in the crowded and roaring cities. It is a real enjoyment to spend the holidays with family or friends in the countryside, or in the mountain, or by the river for body and spirit refreshment.

Generally, camping shelter is provided by a relatively simple tent that is easily folded and carried and set up anywhere. Unfortunately, the simple structure of known tents is not completely satisfactory. Since the customary tent provides only a shelter location without any other equipments, it is inevitable that the camping people do not feel as comfortable and convenient as they are at home. This reduces the fun of the camping.

To overcome the inconveniences of known tents, this invention has designed an air filling tent with the facilities for the household daily use, with which the camping people will get a more perfect and convenient activity circumstance and increase the fun of the camping.

DETAILED DESCRIPTION OF PREFERRED EMBODIMENT

Figure 1:
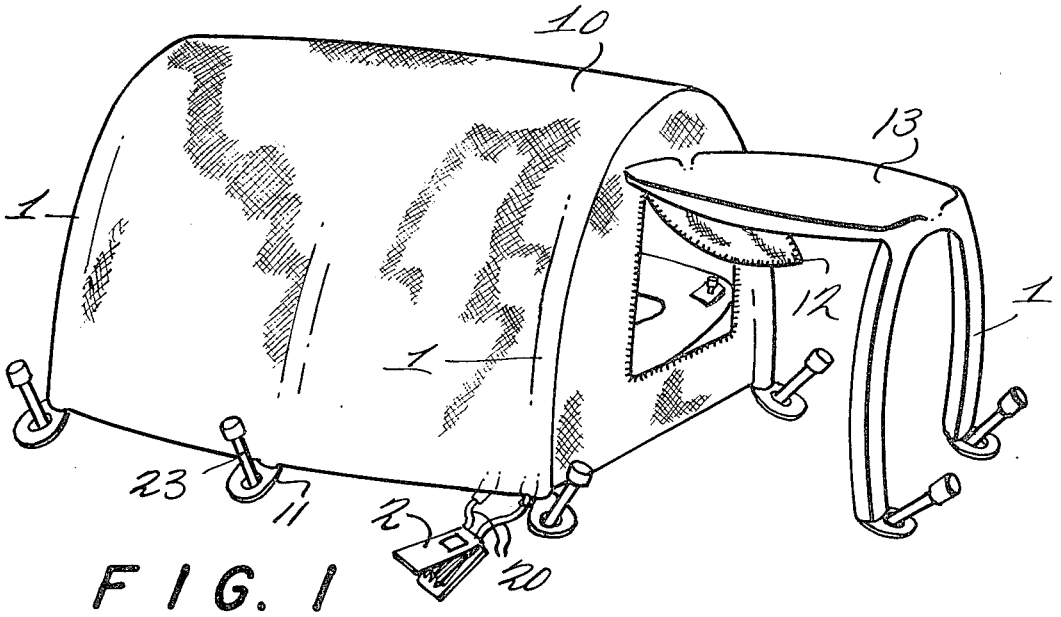
FIG. 1 is an exterior perspective view of a first embodiment of the present invention.
Figure 2:
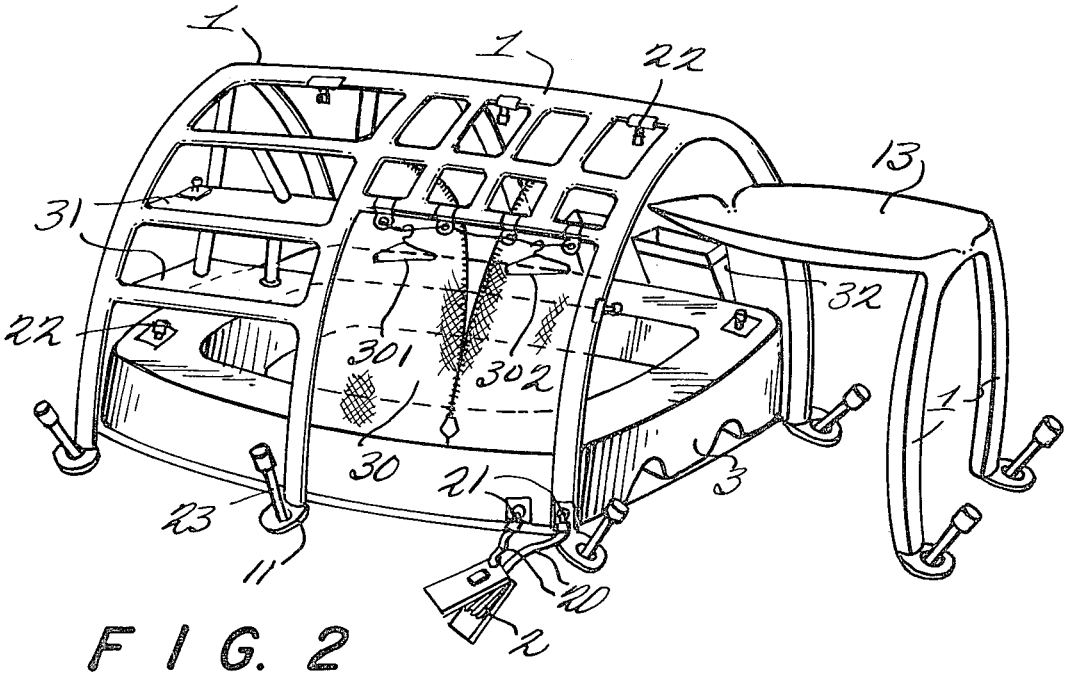
FIG. 2 is an interior perspective view of the first embodiment of the present invention.

Referring now to FIGS. 1 and 2 which are respectively external and interior perspective views of a tent according to the present invention, the tent is of the air filling type. Air posts(1) constitute an integral frame of the tent and interconnect with one another. After expansion by air filling, posts 1 become the supports of the tent. The tent surface(10) that connects with the air posts(1) constitutes the outer wall and it takes on a "house" shape after setting up. A foot-operated air pump filling installation(2) connects the nozzles(21) of the air posts(1) with an air filling pipe(20) in order to provide means for air filling. Of course, other means may be provided for air-filling without departing from the spirit of the present invention. Post lug rings 11 are provided at the feet of the air posts(1) for securing the tent to the ground with stakes(23) at selected positions. The foot pump air filling installation(2) can be removed after the tent has been inflated. Air outlets(22) are provided on the surface of air posts(1). When breaking the camp, the air in the air posts(1) can be released through the air outlets(22) till it is completely exhausted, and after that, the tent can be folded and packed.

A tent door(12) is provided with a zipper closure for ingress to and egress from the tent. An extended protective curtain 13 is provided for added shelter.

The FIGS. 1 and 2 embodiments of this invention provide a tent for sitting, lying down, resting and sleeping. Its inner facilities include an air mattress bed(3), a closet (30), a storage rack(31) and storage bags(32). The air mattress bed(3) has a protruding surrounding, which is formed after air filling as does its bottom. This formation provides not only a comfortable location for sitting and lying down, but it prevents water penetration when it is raining. The closet(30) is formed by utilizing a part of the inner wall space, due to the close situation of the closet and the operation of its zipper, it is similar to ordinary household wardrobe. Closet 30 includes a garment rack rope(301) for holding the garment hangers(302). The supports of the storage rack(31) are the branch posts which connect with the air posts(1). Storage rack(31) forms at the same time that the tent is air filled, therefore, some miscellaneous objects can be put on it. One or more storage bags(32) can be provided on the inner wall of the tent for storing clothings and other objects.

Figure 3:
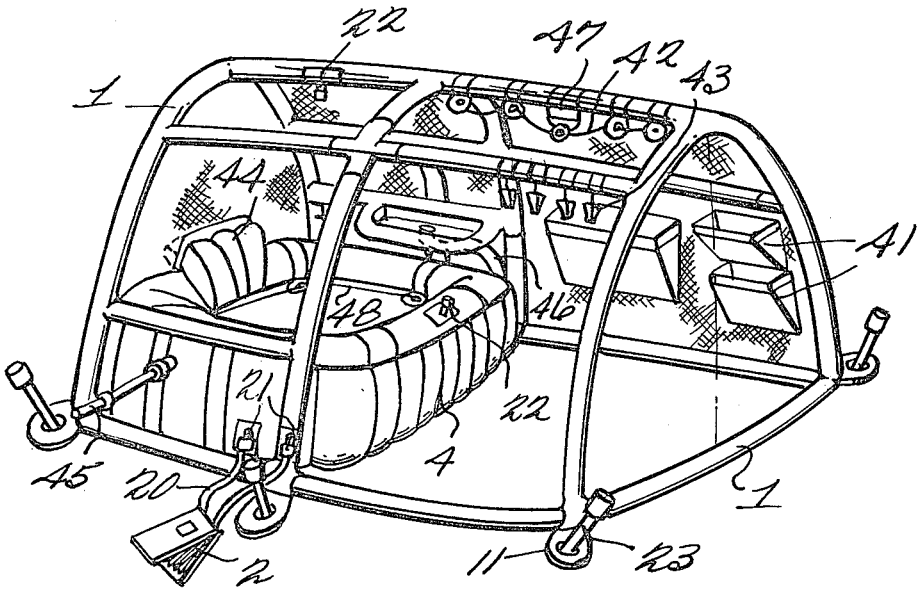
FIG. 3 is a perspective view of a second embodiment of the invention including a bathtub.
Figure 3A:
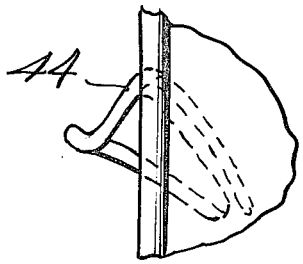
FIG. 3A is a detail of a portion of the construction of the tent shown in FIG. 3, showing its water inlet.

FIG. 3 is an internal perspective view of an alternate embodiment of this invention. The structure is similar to that of FIGS. 1 and 2 embodiment. However, its interior includes a bath tub(4), a wash basin(40), a clothing bags(41), a garment hanging rope(42) and a towel clip(43). Its main bath tub and wash basin are formed by air filling. Over bath tub(4) is provided a water inlet(44), and an opening at one end of the water inlet(44) is extended out of the tent providing an access to pour water into the bath tub(4) from outside. The bath tub(4) and the wash basin(40) include respective water outlet(45) (46) for draining waste water outside the tent. A lamp 47 is provided for illuminating the interior of the tent. The circumference of bath tub is surrounded with rope(48). The rope's function is to preserve the shape of bath tub(47) when it is filled with water and tends to distort under the force of gravity. The second embodiment of this invention provides a perfect bathing facilities for camping people.

Figure 4:
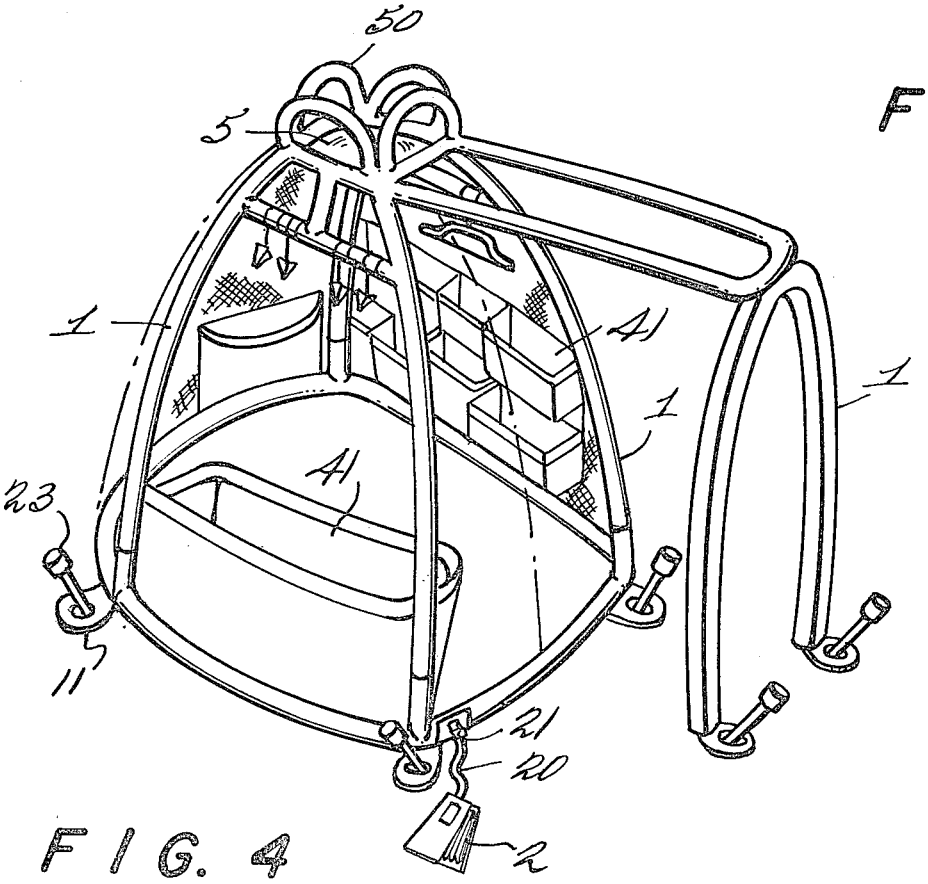
FIG. 4 is a perspective view of a third embodiment of the present invention showing a tent particularly well-suited for dressing.

A third embodiment of the invention, shown in FIG. 4 illustrates a tent particularly well suited for dressing. Its interior includes various sized clothing bags for storing clothing to be laundered; a transparent skylight(5) is provided in the roof for lighting, and avoid a Peeping Tom, a shelter board(50) is set around the skylight(5) to this effect.

I claim:

1. A tent, comprising:

an air-post frame having a plurality of substantially vertically oriented portions and a plurality of substantially horizontally oriented portions;

means for inflating and deflating said air-post frame;

a tent surface integrally formed with said air-post frame;

an air mattress bed integrally formed with said air-post frame and having an extended periphery and wave-shaped bottom for isolating a sleeping surface thereof from rain water;

a storage bag formed integrally with an interior portion of the tent surface;

a zipper-closure closet formed in an inner wall space of the interior of said tent surface including a garment rack rope hung on at least one horizontally oriented portion of said air-post superstructure;

a storage shelf integrally formed with said air-post frame;

a zipper-closure tent door formed in a portion of said tent surface; and a canopy, integrally formed with said tent surface and said air-post frame, sheltering an area immediately outside said tent at said tent door.

2. A tent comprising:

an air-post frame having a plurality of substantially vertically oriented portions and a plurality of substantially horizontally oriented portions;

means for inflating and deflating said air-post frame;

a tent surface integrally formed with said air-post frame;

a bathtub having air-fillable walls, integrally formed with said air-post frame, the upper periphery of the bathtub including a rope having the ability to resist tensile force for preventing substantial deformation of the bathtub when it is filled with water;

a water inlet, integrally formed with a portion of said tent surface and above said bathtub for filling said bathtub with water from the exterior of said tent;

a water outlet for draining water from said tub to the outside of said tent;

a wash basin having air inflatable walls, integrally formed with said air-post frame and tent surface;

a water inlet, integrally formed with said tent surface for filling said wash basin with water from the exterior of said tent;

a water outlet for draining water from said wash basin;

a towel clip fastened to a substantially horizontally oriented portion of said air-post frame; and a storage bag formed integrally with an interior portion of the tent surface.

3. A tent comprising:

an air-post frame having a plurality of substantially vertically oriented portions and at least one substantially horizontally oriented portion;

means for inflating and deflating said air-post frame;

a tent surface integrally formed with said air-post frame;

a plurality of clothing bags, integrally formed with said tent surface on an interior portion thereof;

a skylight formed substantially at the uppermost portion of said tent for admitting light into the interior thereof;

a shelter board formed by the configuration of said air-post frame and positioned about said skylight for providing privacy;

a plurality of garmet hanging clips fixed to said substantially horizontally oriented portion of said air-post frame for hanging clothes; and a plurality of clothing bags of various sizes, integrally formed with an interior portion of said tent surface.

* * * * *